US006145208A

United States Patent [19]

Savage

[11] Patent Number: 6,145,208

[45] Date of Patent: Nov. 14, 2000

[54] PENDULUM SIGHT

[76] Inventor: Huey P. Savage, P.O. Box 1589, Oak Grove, La. 71263

[21] Appl. No.: 09/245,566

[22] Filed: Feb. 5, 1999

[51] Int. Cl.[7] ..... F41G 1/00

[52] U.S. Cl. ..... 33/265; 124/87

[58] Field of Search ..... 33/265, 391, 402; 124/87

[56] References Cited

U.S. PATENT DOCUMENTS

| | | | |
|---|---|---|---|
| 2,523,419 | 9/1950 | Budack | 33/391 |
| 3,013,336 | 12/1961 | Pennington | 33/265 |
| 3,477,130 | 11/1969 | Egan | 33/265 |
| 4,120,096 | 10/1978 | Keller | 33/265 |
| 4,580,349 | 4/1986 | Webb et al. | 33/265 |
| 4,711,036 | 12/1987 | Morris | 33/265 |
| 4,720,919 | 1/1988 | Saunders | 33/265 |
| 4,747,217 | 5/1988 | Austin | 33/391 |
| 4,974,328 | 12/1990 | Lowry | 33/265 |
| 5,253,423 | 10/1993 | Sullivan, Jr. et al. | 33/265 |
| 5,388,336 | 2/1995 | Pomaville | 33/265 |
| 5,454,169 | 10/1995 | Keller | 33/265 |
| 5,539,989 | 7/1996 | Potter | 33/265 |
| 6,058,921 | 9/1950 | Lawrence et al. | 124/87 |

*Primary Examiner*—G. Bradley Bennett
*Attorney, Agent, or Firm*—Joseph N. Breaux

[57] ABSTRACT

A pendulum sight for archery bows that includes a bow mounting bracket secured to a pendulum support frame and a pendulum pivotally mounted to the pendulum support frame with a pivoting pendulum axle having two axle ends. The improvement includes providing one or more vibration/noise damping elements between moving and or contacting points of the pendulum sight to minimize or eliminate noise generated by the pendulum sight that results from vibrations created by shooting an arrow from a bow to which the pendulum sight is affixed.

4 Claims, 5 Drawing Sheets

FIG.4
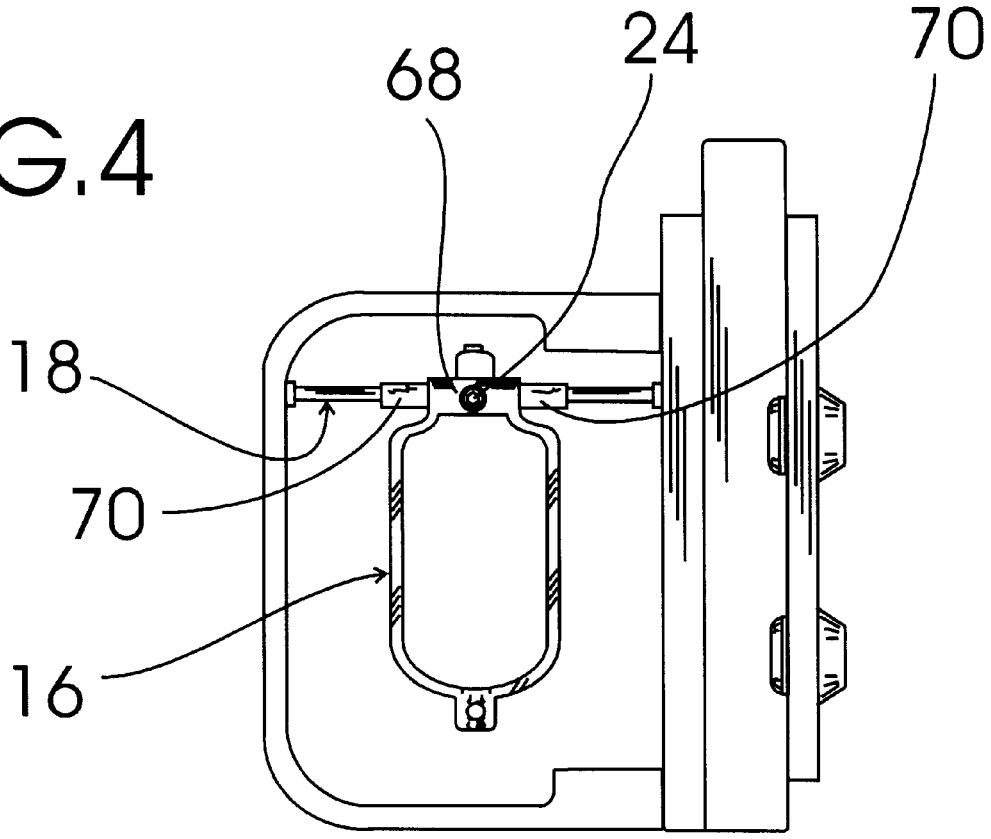
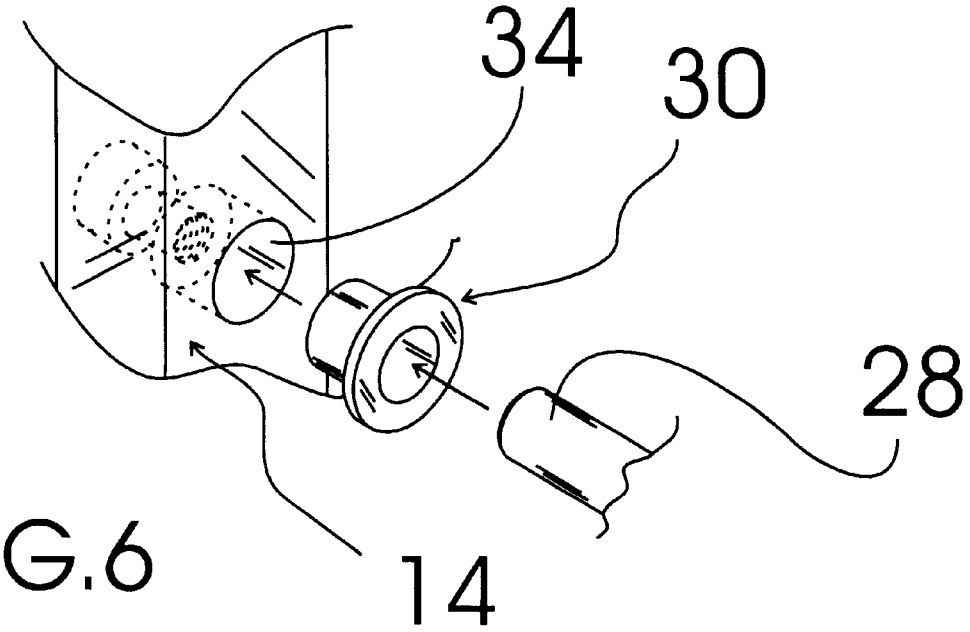
FIG.6

PENDULUM SIGHT

TECHNICAL FIELD

The present invention relates to pendulum sights for archery bows and more particularly to an improved pendulum sight of the type including a bow mounting bracket secured to a pendulum support frame and a pendulum pivotally mounted to the pendulum support frame with a pivoting pendulum axle; the improvement including positioning each of the axle ends of the pivoting pendulum axle into one of two axle end cups secured to the pendulum support frame; each axle end cup having an axle receiving cavity formed therein that is partially defined by a cavity bottom surface that has an axle end contact protrusion extending into the axle receiving cavity from the center of the cavity bottom surface, the axle end contact protrusion preventing the end of the pivoting pendulum axle from contacting the cavity bottom surface, the two axle end cups providing vibrational damping between the axle ends and the pendulum support frame to minimize noise generated by vibrations resulting from firing an arrow.

BACKGROUND ART

Pendulum sights are often used by archery hunters that hunt from tree stands and other elevated positions. Although the use of a pendulum sight when hunting from such an elevated position can increase the aiming accuracy of the hunter, because pendulum sights include a pivoting pendulum, they can generate noise when subjected to the vibrations associated with releasing an arrow from the bow that can spook the game animal and cause it to bolt while the arrow is in flight. It would be a benefit, therefore, to have a pendulum sight that included vibrational noise damping elements for damping the noise generated when the pendulum sight is subjected to the vibrations associated with releasing an arrow from the bow.

GENERAL SUMMARY DISCUSSION OF INVENTION

It is thus an object of the invention to provide an improved pendulum sight that includes vibrational noise damping elements.

It is a further object of the invention to provide an improved pendulum sight that includes the improvement of positioning each of the axle ends of the pivoting pendulum axle into one of two axle end cups secured to the pendulum support frame; each axle end cup having an axle receiving cavity formed therein that is partially defined by a cavity bottom surface that has an axle end contact protrusion extending into the axle receiving cavity from the center of the cavity bottom surface, the axle end contact protrusion preventing the end of the pivoting pendulum axle from contacting the cavity bottom surface; the two axle end cups providing vibrational damping between the axle ends and the pendulum support frame to minimize noise generated by vibrations resulting from firing an arrow.

It is a still further object of the invention to provide an improved pendulum sight that includes vibrational noise damping elements that are biased against the axle ends of the pivoting pendulum axle by a side-play elimination mechanism that is adjustable by the user.

It is a still further object of the invention to provide an improved pendulum sight that accomplishes all or some of the above objects in combination.

Accordingly, an improved pendulum sight is provided. The improvement is for pendulum sights that include a bow mounting bracket secured to a pendulum support frame and a pendulum pivotally mounted to the pendulum support frame with a pivoting pendulum axle; the improvement including positioning each of the axle ends of the pivoting pendulum axle into one of two axle end cups secured to the pendulum support frame; each axle end cup having an axle receiving cavity formed therein that is partially defined by a cavity bottom surface that has an axle end contact protrusion extending into the axle receiving cavity from the center of the cavity bottom surface, the axle end contact protrusion preventing the end of the pivoting pendulum axle from contacting the cavity bottom surface; the two axle end cups providing vibrational damping between the axle ends and the pendulum support frame to minimize noise generated by vibrations resulting from firing an arrow.

In a preferred embodiment the improvement further includes providing an side-play elimination mechanism including a threaded axle side-play set screw passage formed into the pendulum support frame into one of the axle end cup receiving cavities and a threaded side-play set screw companionately threaded to engage the threads of the threaded axle side-play set screw passage and of sufficient length to generate a lateral force against an axle end cup positioned within axle end cup receiving cavity and force the axle end contact protrusion against an axle end of the pivoting pendulum axle when screwed sufficiently into the threaded axle side-play set screw passage.

When the pendulum of the pendulum sight is adjustably positionable along the pivoting pendulum axle it is also preferable to further include two tubular axle/pendulum damping elements positioned over the pivoting pendulum axle and against each side of the pendulum to damp vibrational noise caused by vibrations resulting from firing an arrow.

Because vibrational noise can be generated between the forward or rearward stops and the pendulum support frame, it is also preferable to provide a resilient forward vibration damping structure in connection with the pendulum in a manner to contact the pendulum support frame to stop forward rotation of the pendulum and a resilient rearward vibration damping structure in connection with the pendulum in a manner to contact the pendulum support frame to stop rearward rotation of the pendulum.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 4 is a back plan view showing the pendulum support frame; the pendulum; the pivoting pendulum axle; the two axle end cups; the resilient rearward vibration damping structure; the resilient forward vibration damping structure; and the two tubular-shaped axle/pendulum damping elements.

FIG. 6 is an exploded, partial, perspective view showing one of the axle ends; one of the axle end cups; one of the two opposed, concentrically aligned axle end cup receiving cavities; and the side-play elimination mechanism (shown in dashed lines) including the threaded axle side-play set screw passage formed into the pendulum support frame and the threaded side-play set screw.

EXEMPLARY MODE FOR CARRYING OUT THE INVENTION

Figure 1:
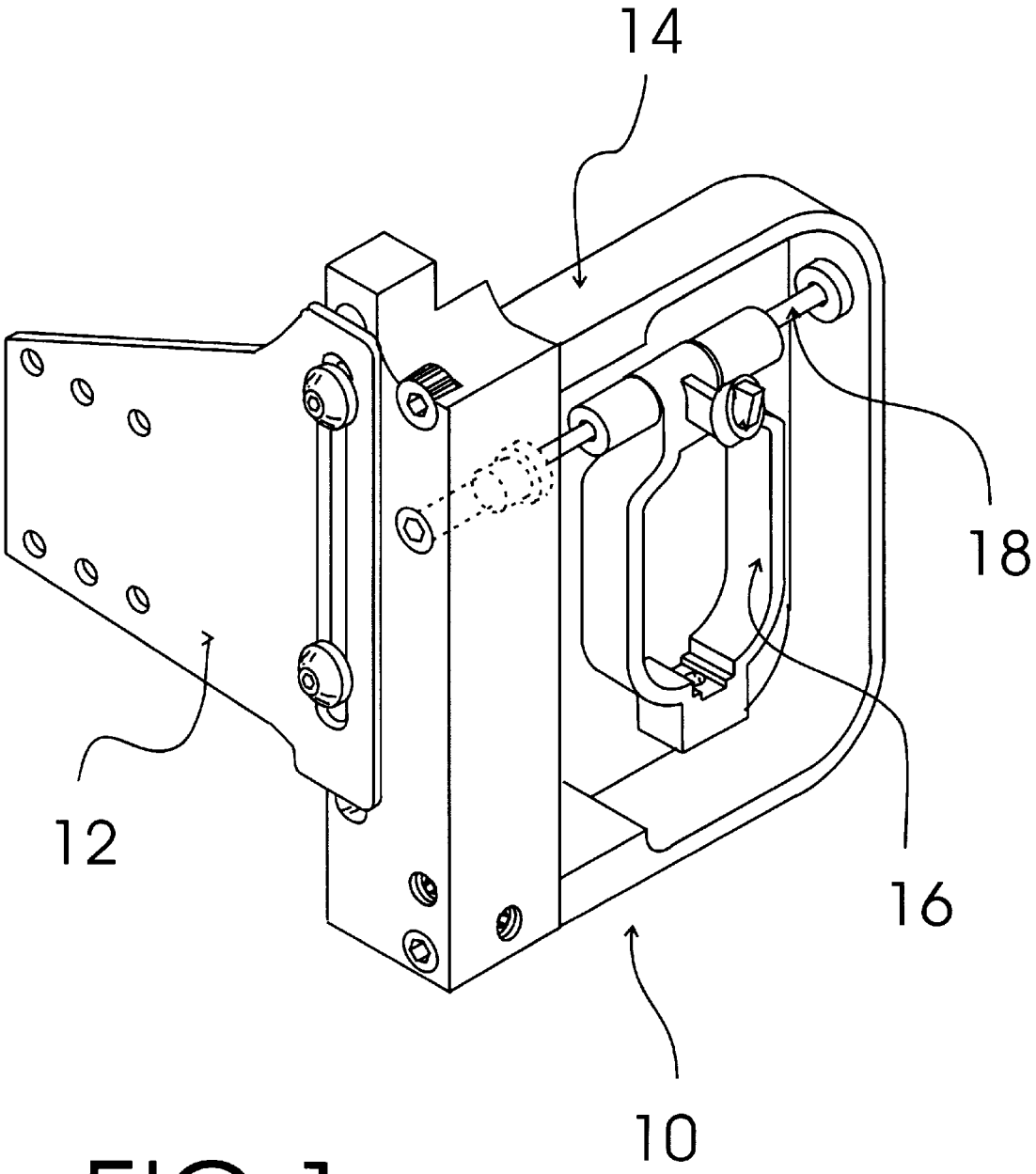
FIG. 1 is a perspective view of an improved pendulum sight of the invention showing a representative pendulum sight having an exemplary embodiment of the improvement of the present invention incorporated therein; the representative pendulum sight including a bow mounting bracket secured to a pendulum support frame and a pendulum pivotally mounted to the pendulum support frame with a pivoting pendulum axle; the exemplary improvement comprising two axle end cups each having an axle receiving cavity formed therein that is partially defined by a cavity bottom surface that has an axle end contact protrusion extending into the axle receiving cavity from the center of the cavity bottom surface, the axle end contact protrusion preventing the end of the pivoting pendulum axle from contacting the cavity bottom surface; two opposed, concentrically aligned axle end cup receiving cavities formed into the pendulum support frame, each axle end cup receiving cavity being sized to frictionally receive therein a portion of one of the two axle end cups; a side-play elimination mechanism including a threaded axle side-play set screw passage formed into the pendulum support frame into one of the axle end cup receiving cavities and a threaded side-play set screw companionately threaded to engage the threads of the threaded axle side-play set screw passage and of sufficient length to generate a lateral force against an axle end cup positioned within axle end cup receiving cavity and force the axle end contact protrusion against an axle end of the pivoting pendulum axle when screwed sufficiently into the threaded axle side-play set screw passage; a resilient forward vibration damping structure in connection with the pendulum in a manner to contact the pendulum support frame to stop forward rotation of the pendulum; a resilient rearward vibration damping structure in connection with the pendulum in a manner to contact the pendulum support frame to stop rearward rotation of the pendulum; and two tubular axle/pendulum damping elements positioned over the pivoting pendulum axle and against each side of the pendulum to damp vibrational noise caused by vibrations resulting from firing an arrow.

FIG. 1 shows an improved pendulum sight of the invention, generally designated 10. Improved pendulum sight 10 includes a bow mounting bracket, generally designated 12, secured to a pendulum support frame, generally designated 14, and a pendulum, generally designated 16, pivotally mounted to pendulum support frame 14 with a pivoting pendulum axle, generally designated 18.

Figure 2:
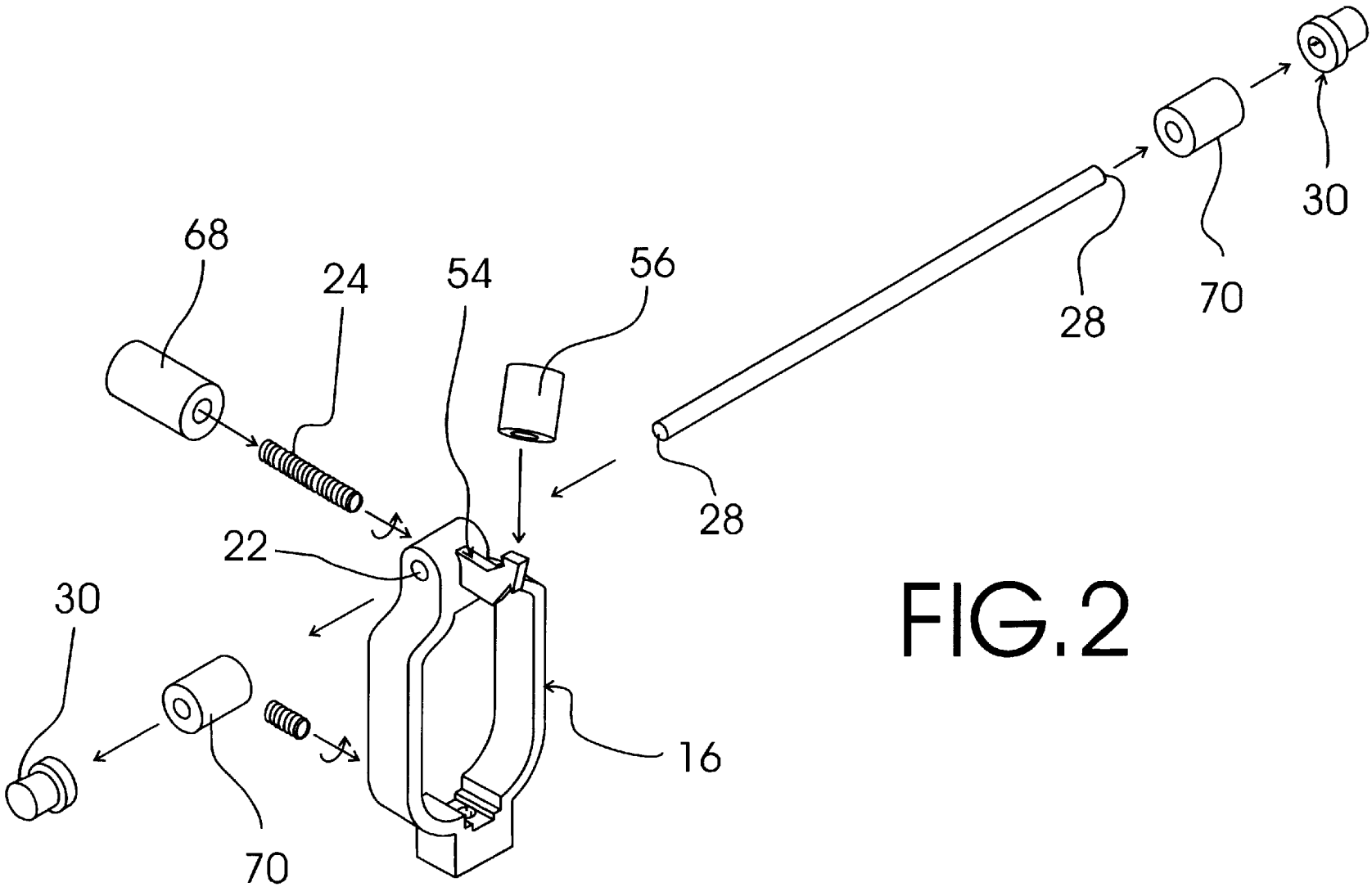
FIG. 2 is a partial exploded perspective view of a portion of the improved pendulum sight of FIG. 1 showing the pendulum including the axle passage, the axle locking set screw, the sight pin fitting and the sight pin locking set screw; the pivoting pendulum axle sized to slide through the axle passage of the pendulum and including first and second axle ends; two molded plastic axle end cups each having an axle receiving cavity formed therein for receiving one of the first and second axle ends; a tubular-shaped, resilient forward vibration damping structure positionable over the integrally molded forward pendulum stop; the tubular-shaped, resilient rearward vibration damping structure positionable over the end of the axle locking set screw; and the two tubular axle/pendulum damping elements positioned over the pivoting pendulum axle and against each side of the pendulum to damp vibrational noise caused by vibrations.
Figure 3:
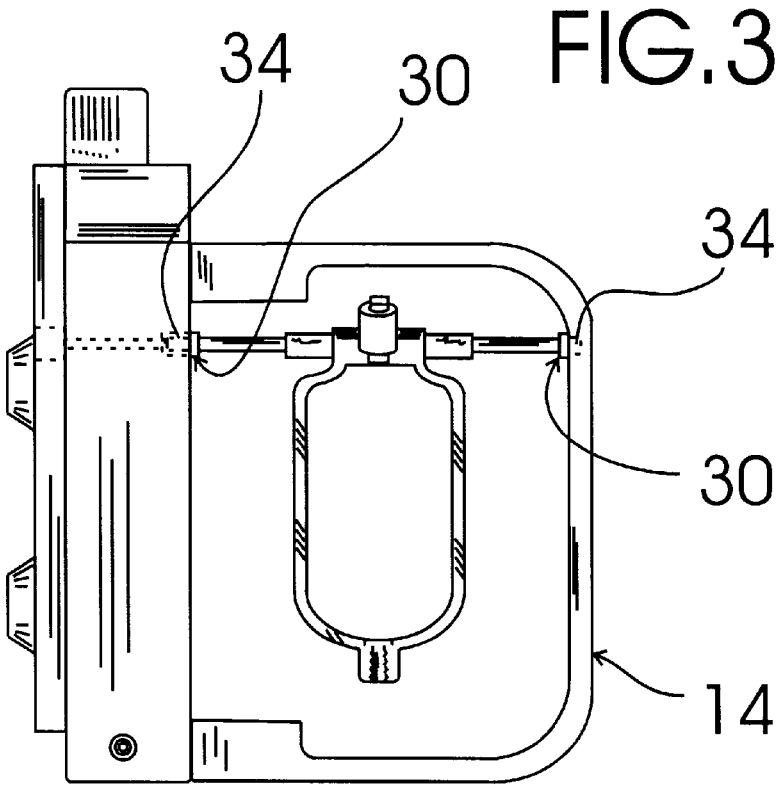
FIG. 3 is a front plan view showing the pendulum support frame; the pendulum; the pivoting pendulum axle; the two axle end cups each positioned within one of the two opposed, concentrically aligned axle end cup receiving cavities formed into the pendulum support frame; the side-play elimination mechanism (shown in dashed lines) including the threaded axle side-play set screw passage formed into the pendulum support frame and the threaded side-play set screw; the resilient forward vibration damping structure; and the two tubular-shaped axle/pendulum damping elements.
Figure 9:
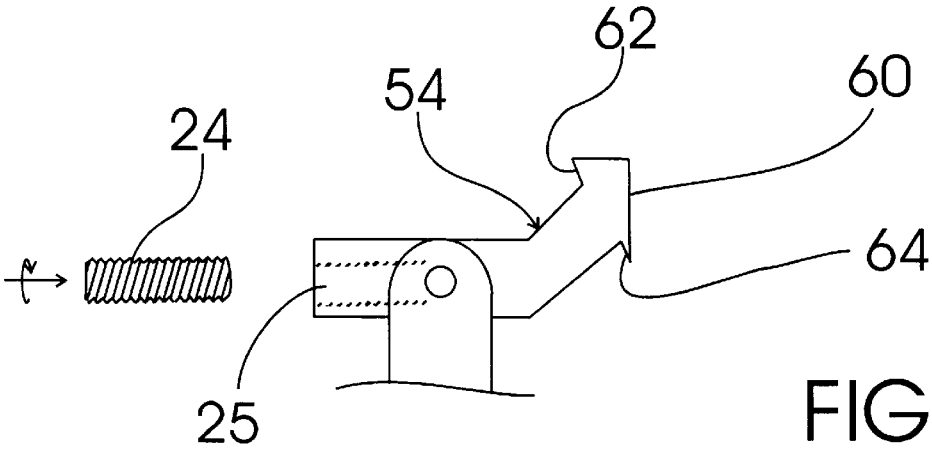
FIG. 9 is a partial side plan view of the top portion of the pendulum showing the axle passage, the threaded axle locking set crew passage (shown in dashed lines), the axle locking set screw, and the integrally molded forward pendulum stop; the pendulum stop including upper and lower vibration damping structure retaining ledges formed at the outward most end thereof.

With reference now to FIG. 2, pendulum 16 is of molded construction and includes an axle passage 22 formed through a top portion thereof and an axle locking set screw 24 that is threadable into a threaded axle locking set screw passage 25 (shown in dashed lines FIG. 9) to lock pendulum 16 in a user set fixed position along pivoting pendulum axle 18. Pivoting pendulum axle 18 includes two axle ends 28 (see also FIG. 6) that, referring now to FIG. 3, are each set into one of two molded plastic axle end cups, generally designated 30, that themselves are each set into one of two opposed, concentrically aligned axle end cup receiving cavities 34 (shown in dashed lines, see also FIG. 6) formed into the pendulum support frame 14.

Figure 7:
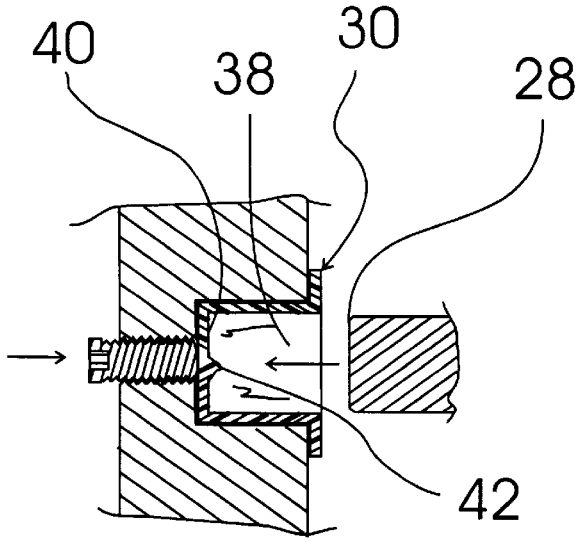
FIG. 7 is an exploded, cross-sectional view showing one of the axle ends; one of the axle end cups inserted into one of the two opposed, concentrically aligned axle end cup receiving cavities; and the side-play elimination mechanism including the threaded axle side-play set screw passage formed into the pendulum support frame and the threaded side-play set screw.
Figure 8:
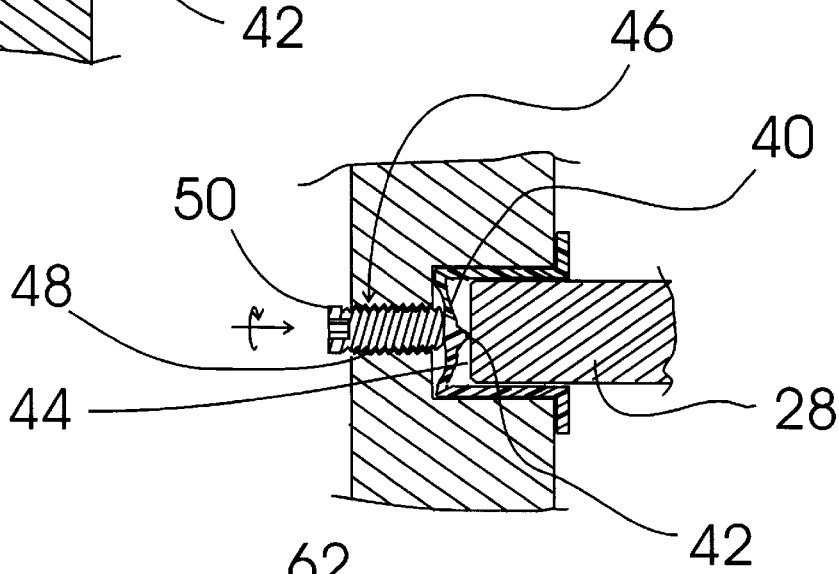
FIG. 8 is an exploded, cross-sectional view showing one of the axle ends of the pivoting pendulum axle positioned within the axle end receiving cavity of one of the axle end cups; one of the axle end cups inserted into one of the two opposed, concentrically aligned axle end cup receiving cavities; and the side-play elimination mechanism including the threaded axle side-play set screw passage formed into the pendulum support frame and the threaded side-play set screw screwed into the threaded axle side-play set screw passage sufficiently to force the axle end contact protrusion of the axle end cup against the axle end of the pivoting pendulum axle.

Referring now to FIG. 7, each axle end cup 30 has an axle receiving cavity 38 formed therein for receiving one of the axle ends 28. Axle receiving cavity 38 is partially defined by a cavity bottom surface 40 that has an axle end contact protrusion 42 extending into axle receiving cavity 38 from the center thereof. Referring now to FIG. 8, axle end contact protrusion 42 prevents the planar tip end surface 44 of axle end 28 from contacting cavity bottom surface 40. In this embodiment a side-play elimination mechanism, generally designated 46 is provided that includes a threaded axle side-play set screw passage 48 formed into pendulum support frame 14 and a threaded side-play set screw 50. Side-play set screw 50 is screwed into threaded axle side-play set screw passage 48 sufficiently to force axle end contact protrusion 42 against planar tip end surface 44 of axle end 28 to minimize side-play and the vibrational noise and sighting errors associated therewith.

Referring back to FIG. 2, pendulum 16 includes an integrally molded forward pendulum stop, generally designated 54, onto which a tubular-shaped, resilient forward vibration damping structure 56 is positioned. Forward vibration damping structure 56 is a length of resilient plastic tubing and is, referring now to FIG. 9, positioned over the outward most end 60 of forward pendulum stop 54. Outward most end 60 includes upper and lower vibration damping structure retaining ledges 62,64 for maintaining, with reference back to FIG. 2, tubular-shaped, resilient forward vibration damping structure 56 thereon.

Figure 5:
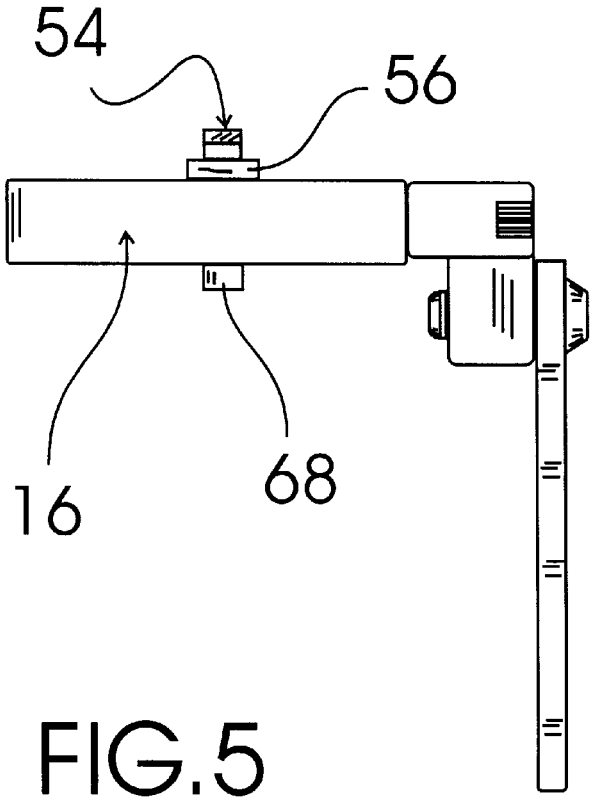
FIG. 5 is a top plan view showing the bow mounting bracket; the pendulum support frame; the resilient rearward vibration damping structure; and the resilient forward vibration damping structure.

In this embodiment, axle locking set screw 24 is of sufficient length to act as a rearward pendulum stop when, referring now to FIG. 4, it is screwed into threaded axle locking set screw passage 25 (FIG. 9) of pendulum 16 and has a tubular-shaped, resilient rearward vibration damping structure 68 positioned over the end thereof (see also FIG. 5).

In this embodiment, two tubular axle/pendulum damping elements 70 are positioned over pivoting pendulum axle 18 and against each side of pendulum 16 to damp vibrational noise between pivoting pendulum axle 18 and pendulum 16. Rearward vibration damping structure 68 and the two tubular axle/pendulum damping elements 70 are each a section of resilient plastic tubing having an inner diameter sized to allow rearward vibration damping structure 68 and the two tubular axle/pendulum damping elements 70 to grip and hold the structures on which they are mounted.

It can be seen from the preceding description that an improved pendulum sight has been provided that includes an improved pendulum sight that includes vibrational noise damping elements; that includes the improvement of positioning each of the axle ends of the pivoting pendulum axle into one of two axle end cups secured to the pendulum support frame; each axle end cup having an axle receiving cavity formed therein that is partially defined by a cavity bottom surface that has an axle end contact protrusion extending into the axle receiving cavity from the center of the cavity bottom surface, the axle end contact protrusion preventing the end of the pivoting pendulum axle from contacting the cavity bottom surface; the two axle end cups providing vibrational damping between the axle ends and the pendulum support frame to minimize noise generated by vibrations resulting from firing an arrow; and that includes the improvement of vibrational noise damping elements that are biased against the axle ends of the pivoting pendulum axle by a side-play elimination mechanism that is adjustable by the user.

It is noted that the embodiment of the improved pendulum sight described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. In a pendulum sight that includes a bow mounting bracket secured to a pendulum support frame and a pendulum pivotally mounted to the pendulum support frame with a pivoting pendulum axle having two axle ends; the improvement comprising:

positioning each of the axle ends of the pivoting pendulum axle into one of two axle end cups secured to the pendulum support frame;

each axle end cup having an axle receiving cavity formed therein that is partially defined by a cavity bottom surface that has an axle end contact protrusion extending into the axle receiving cavity from the center of the cavity bottom surface, the axle end contact protrusion preventing the end of the pivoting pendulum axle from contacting the cavity bottom surface;

the two axle end cups providing vibrational damping between the axle ends and the pendulum support frame to minimize noise generated by vibrations resulting from firing an arrow.

2. The improved pendulum sight of claim 1 wherein the pendulum support frame has two concentrically aligned, opposed axle end cup receiving cavities formed therein;

each axle end cup is partially positioned into one of the axle end cup receiving cavities; and the improved pendulum sight further comprises:

a side-play elimination mechanism including a threaded axle side-play set screw passage formed into the pendulum support frame into one of the axle end cup receiving cavities and a threaded side-play set screw companionately threaded to engage the threads of the threaded axle side-play set screw passage and of sufficient length to generate a lateral force against an axle end cup positioned within the axle end cup receiving cavity and force the axle end contact protrusion against the axle end of the pivoting pendulum axle when screwed sufficiently into the threaded axle side-play set screw passage.

3. The improved pendulum sight of claim 1 wherein the pendulum of the pendulum sight is adjustably positionable along the pivoting pendulum axle; and the improved pendulum sight further comprises:

two tubular, resilient, axle/pendulum damping elements positioned over the pivoting pendulum axle and against each side of the pendulum to damp vibrational noise caused by vibrations resulting from firing an arrow.

4. The improved pendulum sight of claim 1 further comprising:

a resilient forward vibration damping structure in connection with the pendulum in a manner to contact the pendulum support frame to stop forward rotation of the pendulum: and a resilient rearward vibration damping structure in connection with the pendulum in a manner to contact the pendulum support frame to stop rearward rotation of the pendulum.

* * * * *